US006651627B2

(12) United States Patent
Zdroik et al.

(10) Patent No.: US 6,651,627 B2
(45) Date of Patent: Nov. 25, 2003

(54) FUEL RAIL PULSE DAMPER

(75) Inventors: Michael J. Zdroik, Metamora, MI (US); Robert J. Doherty, Syracuse, IN (US)

(73) Assignee: Millennium Industries Corp., Cass City, MI (US)

( * ) Notice: Subject to any disclaimer, the term of this patent is extended or adjusted under 35 U.S.C. 154(b) by 27 days.

(21) Appl. No.: 10/021,215

(22) Filed: Dec. 12, 2001

(65) Prior Publication Data

US 2003/0106535 A1 Jun. 12, 2003

(51) Int. Cl.[7] ..... F02M 55/02
(52) U.S. Cl. ..... 123/456; 123/467
(58) Field of Search ..... 123/456, 467, 123/468; 138/26, 30

(56) References Cited

U.S. PATENT DOCUMENTS 4,649,884 A 3/1987 Tuckey
5,505,181 A 4/1996 McRae et al.
5,845,621 A 12/1998 Robinson et al.
5,894,861 A 4/1999 Lorraine
5,896,843 A 4/1999 Lorraine
5,954,031 A * 9/1999 Ogiso et al. ..... 123/447
6,032,651 A * 3/2000 Field ..... 123/467
6,135,092 A 10/2000 Schaenzer et al.
6,182,637 B1 * 2/2001 Kilgore et al. ..... 123/467
6,205,979 B1 3/2001 Sims, Jr. et al.
6,230,685 B1 * 5/2001 Kilgore et al. ..... 123/467
6,321,719 B1 * 11/2001 Schwegler ..... 123/467
6,336,442 B1 * 1/2002 Kilgore ..... 123/456
2002/0139426 A1 * 10/2002 Kippe et al. ..... 138/30

* cited by examiner

*Primary Examiner*—Thomas N. Moulis
(74) *Attorney, Agent, or Firm*—Dykema Gossett PLLC

(57) ABSTRACT

A fuel rail for an automotive vehicle with a spark-ignited, reciprocating piston internal combustion engine is provided. The fuel rail has a tubular body with a fuel inlet and a plurality of injector outlets. A damper is provided with a lower cup connected to the tubular body. The damper also has an upper cup with a diaphragm sealably separating the cups.

25 Claims, 3 Drawing Sheets

FUEL RAIL PULSE DAMPER

FIELD OF THE INVENTION

The field of the present invention is fuel rails for internal combustion engines and, in particular, fuel rails for spark-ignited, reciprocating piston internal combustion engines.

BACKGROUND OF THE INVENTION

During the past three decades, a major technological effort has taken place to increase the fuel efficiency of automotive vehicles. One technical trend to improve fuel efficiency has been to reduce the overall weight of the vehicle. A second trend has been to improve the aerodynamic design of a vehicle to lower aerodynamic drag. Another trend to increase fuel efficiency is to address the overall fuel efficiency of the engine.

Prior to 1970, the majority of production vehicles with a reciprocating piston gasoline engine had a carburetor fuel supply system. In the carburetor fuel supply system, gasoline is delivered via the engine throttle body and is therefore mixed with the incoming air. Accordingly, the amount of fuel delivered to any one cylinder is a function of the incoming air delivered to a given cylinder. Airflow into a cylinder is affected by many variables including the flow dynamics of the intake manifold and the flow dynamics of the exhaust system.

To increase fuel efficiency and to better control exhaust emissions, many vehicle manufacturers went to port fuel injector systems, which replaced the carburetor with fuel injectors that injected the fuel into a port which typically served a plurality of cylinders.

Although port fuel injection is an improvement over the carburetor fuel supply system, in a step to further enhance fuel delivery, many spark-ignited gasoline engines have gone to a system wherein a fuel injector is supplied for each individual cylinder. The fuel injectors receive fuel from a fuel rail, which is typically connected to all or half of the fuel injectors on one bank of an engine. In-line 4, 5 and 6 cylinder engines typically have one bank. V-block type engines have two banks.

One critical aspect of a fuel rail application is the delivery of a precise amount of fuel at a precise pressure. In an actual application, the fuel is delivered to the rail from the fuel pump in the vehicle fuel tank. In an engine-off condition, the pressure within the fuel rail is typically 45 to 60 psi. When the engine is started, an injector firing momentarily depletes the fuel locally in the fuel rail and then the sudden closing of the injector creates a pressure pulse back into the fuel rail.

The opening and closing of the injectors creates pressure pulsations up and down the fuel rail, creating an undesirable condition wherein the pressure locally at a given injector may be higher or lower than the injector is ordinarily calibrated to. If the pressure adjacent to the injector within the fuel rail is outside a given calibrated range, then the fuel delivered upon the next opening of the fuel injector may be higher or lower than what is desired.

Fuel pulsations are also undesirable in that they can generate undesired noise. The pressure pulsations can be exaggerated in many fuel delivery systems wherein a returnless delivery system is utilized where there is a single feed into the fuel rail and the fuel rail has a closed end point. To reduce undesired pulsations within the fuel rails, many fuel rails are provided with pressure pulsation dampers.

Most dampers utilize diaphragms. Most dampers are separate components that are added to the fuel rail as a final assembly step. Most prior dampers utilized an O-ring or gasket as the primary seal. The seals created an additional leak path to the fuel rail and have been problematic. Attempts to add dampers without an O-ring seal after the fuel rail is fabricated (assembled, brazed and leak tested), requires the use of capital intensive equipment such as laser welding or induction brazing.

Some of the requirements for laser welding or induction brazing can be eliminated if the damper is added to the fuel rail before the brazing operation. However, the brazing operation traditionally produces an amount of heat that can often damage the O-ring or gasket, which in many instances, are fabricated from an elastomeric material. The heat from the brazing operation can additionally build up pressure inside the metal damper and cause bursting.

It is desirable to provide a fuel rail with a pulsation damper which eliminates the requirement for utilization of O-rings or gaskets, especially polymeric O-rings or gaskets. It is also desirable to provide a fuel rail that can have the damper added before the fuel rail undergoes final assembly and is brazed and leak tested.

SUMMARY OF THE INVENTION

The present invention provides a fuel rail which incorporates the damper into the fuel rail during the normal manufacturing process. The damper consists of two chambers which are separated by a diaphragm. The damper can be a separate part that is tacked on and finally brazed on into position or an integral feature of the main body of the fuel rail. The fuel rail can be leak tested to guarantee its integrity and the damper may be activated by pressurizing it and capturing pressurized gas or air through a simple induction welding process or by utilization of a mechanical plug. In the event the diaphragm ruptures, a cup of the damper acts as a secondary sealing chamber to stop any external leakage of fuel from the fuel rail.

Other features and advantages of the present invention will become more apparent to those skilled in the art after a review of the invention as it is explained in the accompanying detailed description and drawings.

DETAILED DESCRIPTION OF THE INVENTION

Figure 1:
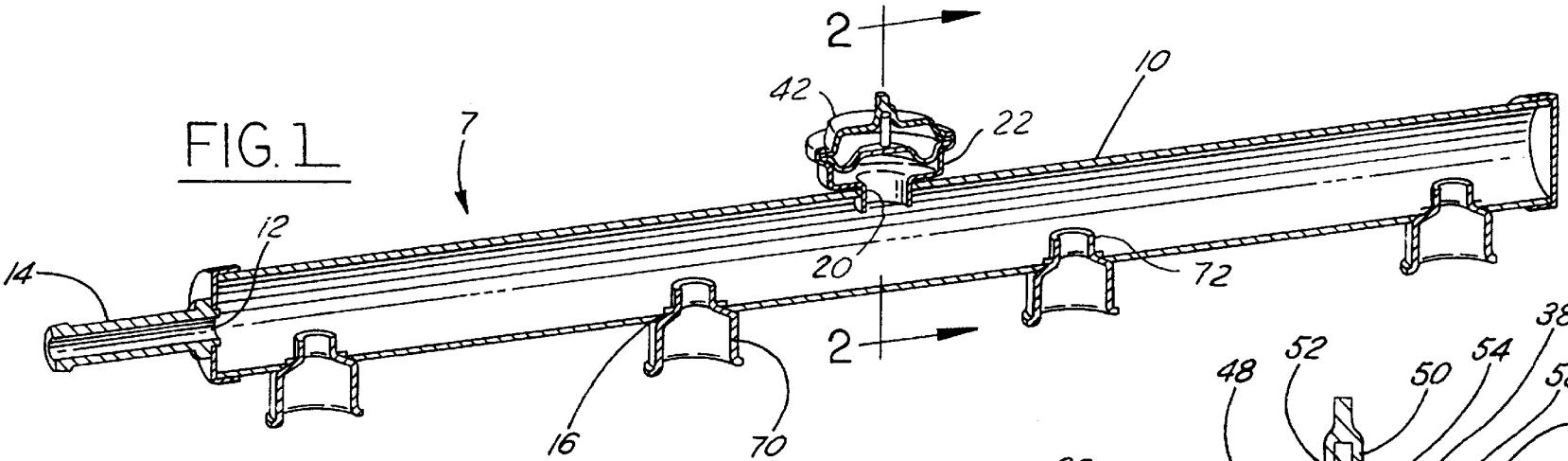
FIG. 1 is a sectional view of a preferred embodiment spark-ignited, reciprocating piston internal combustion engine fuel rail according to the present invention.
Figure 2:
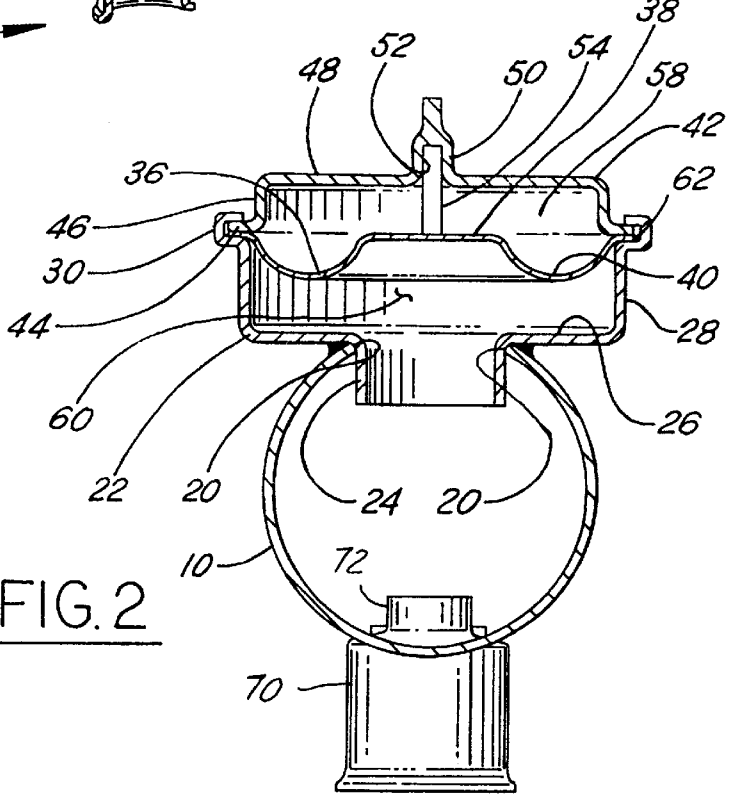
FIG. 2 is a sectional view taken along line 2—2 of FIG. 1.

Referring to FIGS. 1–2, fuel rail 7 is provided for delivering fuel to a spark-ignited, reciprocating piston internal combustion engine. The typical fuel delivered is gasoline.

The fuel rail 7 has a main or tubular body 10. The tubular body 10 has an inlet 12 for the delivery of fuel. Connected to the main body 10 adjacent to the inlet 12 is a hose neck 14. Tubular body 10 has a plurality of injector outlets 16. The tubular body 10 also has a damper or accumulator outlet 20. Fixably connected to the tubular body 10 adjacent the damper outlet 20 is a damper lower cup 22. The damper lower cup 22 has an integral neck 24. The neck 24 flares outwardly into an annular ring portion 26. The annular ring portion 26 is integrally joined to a cylindrical portion 28. The cylindrical portion 28 is integrally joined to a crimped channel 30.

Having its extreme circumferential ends resting in crimped channel 30 is a diaphragm 36. The diaphragm 36 is a generally rigid thin metal member having a generally flat center portion 38 and a cross-sectional curvilinear bent portion 40. The diaphragm 36 is typically made from stainless steel or low carbon steel and is 0.1 to 0.5 mm. thick. Connected on top of the damper lower cup 22 and the diaphragm 36 is a damper upper cup 42.

Damper upper cup 42 has a radial flange portion 44 which is captured within the crimped channel 30. Joined to the radial flange portion 44 is a cylindrical portion 46. The cylindrical portion 46 is integrally joined to a base portion 48. The base portion 48 is connected to damper nose 50. The damper nose 50 forms a pocket 52. The pocket 52 aligns and mounts a travel limiter 54 that slides within.

Prior to the brazing operation, the crimped channel 30 will be formed in the lower cup 22 to connect the lower cup 22 to the upper cup 42. The damper nose 50 will be sealed by deformation in the form of crimping and/or welding or will be simply mechanically plugged.

Figure 3:
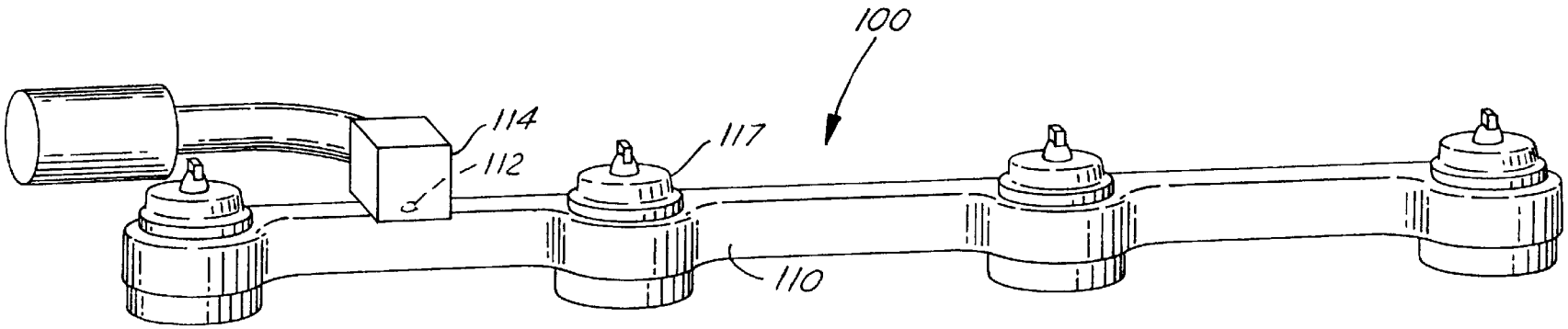
FIG. 3 is a perspective view of an alternate preferred embodiment fuel rail according to the present invention.
Figure 4:
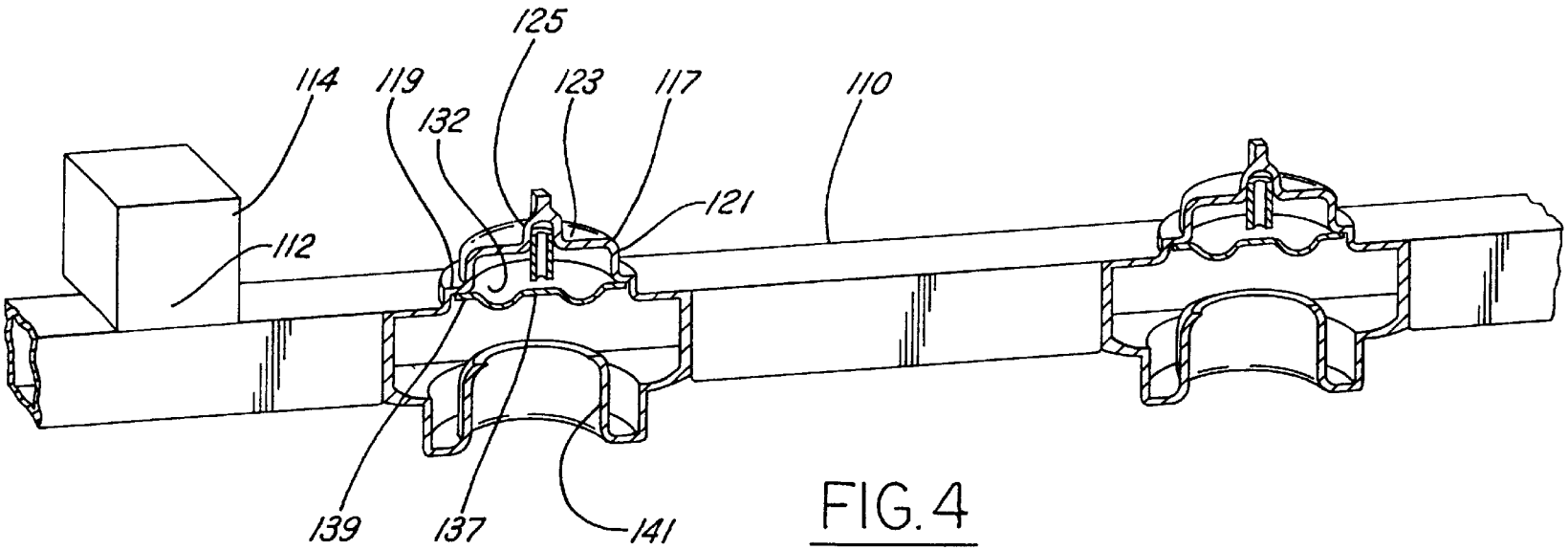
FIG. 4 is an enlarged sectional view of the fuel rail shown in FIG. 1.

Referring to FIGS. 3 and 4, an alternate preferred embodiment fuel rail 100 is provided. Fuel rail 100 has a generally rectangular tubular body 110. The tubular body has a fuel inlet 112 which is covered by a fuel line fitting 114. The tubular body 110 has an integral stamped damper upper cup 117. The upper cup 117 has a radial flange portion 119. Integrally joined to the radial flange portion 119 is a cylindrical portion 121 that is connected to a base portion 123. The base portion 123 has a damper nose 125 which is substantially similar to aforedescribed damper nose 50.

The generally rigid metallic diaphragm 36 separates control volume 58 of the upper cup 42 from control volume 60 of the lower cup 22. The diaphragm 36 will typically have a radial flange portion 62 brazed to the radial flange portion 44 of the upper cup 42.

Damper upper cup 42 has a radial flange portion 44 which is captured within the crimped channel 30. Joined to the radial flange portion 44 is a cylindrical portion 46. The cylindrical portion 46 is integrally joined to a base portion 48. The base portion 48 is connected to damper nose 50. The damper nose 50 forms a pocket 52. The pocket 52 aligns and mounts a travel limiter 54 that slides within.

Prior to the brazing operation, the crimped channel 30 will be formed in the lower cup 22 to connect the lower cup 22 to the upper cup 42. The damper nose 50 will be sealed by deformation in the form of crimping and/or welding or will be simply mechanically plugged.

Referring to FIGS. 3 and 4, an alternate preferred embodiment fuel rail 100 is provided. Fuel rail 100 has a generally rectangular tubular body 110. The tubular body has a fuel inlet 112 which is covered by a fuel line fitting 114. The tubular body 110 has an integral stamped damper upper cup 117. The upper cup 117 has a radial flange portion 119. Integrally joined to the radial flange portion 119 is a cylindrical portion 121 that is connected to a base portion 123. The base portion 123 has a damper nose 125 which is substantially similar to aforedescribed damper nose 50.

Typically, prior to the sealing operation the control volume 58 will be pressurized with a gas to allow its pressure to be above atmospheric and preferably generally equal to a mean pressure, typically between 45 and 60 psi of the gasoline fuel delivered to the tubular body 10.

Fixably connected to the tubular body 10 adjacent to injector outlets 16 are injector cups 70. The injector cups 70 are provided to fit over fuel injectors of the engine bank (not shown). The injector cups have necks 72 that are weldably connected to the tubular body 10. In a similar manner, the damper lower cup 22 is welded or brazed with the tubular body 10.

In operation, fuel is delivered into the fuel injectors through necks 72 of the injector cups 70. Pulsations caused by the opening and closing of the injectors are dampened by the diaphragm 36. The entire fuel rail 7 can be leak tested at the same time since any heat from a brazing operation will not damage any O-ring or gasket. Pressure within the control volume 58 can be preselected to a desired value before the sealing of the damper outlet 50.

Damper upper cup 42 has a radial flange portion 44 which is captured within the crimped channel 30. Joined to the radial flange portion 44 is a cylindrical portion 46. The cylindrical portion 46 is integrally joined to a base portion 48. The base portion 48 is connected to damper nose 50. The damper nose 50 forms a pocket 52. The pocket 52 aligns and mounts a travel limiter 54 that slides within.

Prior to the brazing operation, the crimped channel 30 will be formed in the lower cup 22 to connect the lower cup 22 to the upper cup 42. The damper nose 50 will be sealed by deformation in the form of crimping and/or welding or will be simply mechanically plugged.

Referring to FIGS. 3 and 4, an alternate preferred embodiment fuel rail 100 is provided. Fuel rail 100 has a generally rectangular tubular body 110. The tubular body has a fuel inlet 112 which is covered by a fuel line fitting 114. The tubular body 110 has an integral stamped damper upper cup 117. The upper cup 117 has a radial flange portion 119. Integrally joined to the radial flange portion 119 is a cylindrical portion 121 that is connected to a base portion 123. The base portion 123 has a damper nose 125 which is substantially similar to aforedescribed damper nose 50.

The fuel rail 100 also has a diaphragm 137. The diaphragm 137 is provided with a radial flange portion 139 that is brazed to the radial flange portion 119 of the damper upper cup 117. The diaphragm 137 provides a pressure boundary to isolate the control volume 132 of the damper upper cup 117 from the remainder of the fuel rail 100.

The fuel rail 100 has an integral injector cup 141 which is provided by stamping of the tubular body 110. The stampings providing the injector cup 141 or the upper cup 117 can be provided on different portions of the tubular body 110 and then joined together or may be hydro formed or formed utilizing some other complex forming process.

Figure 5:
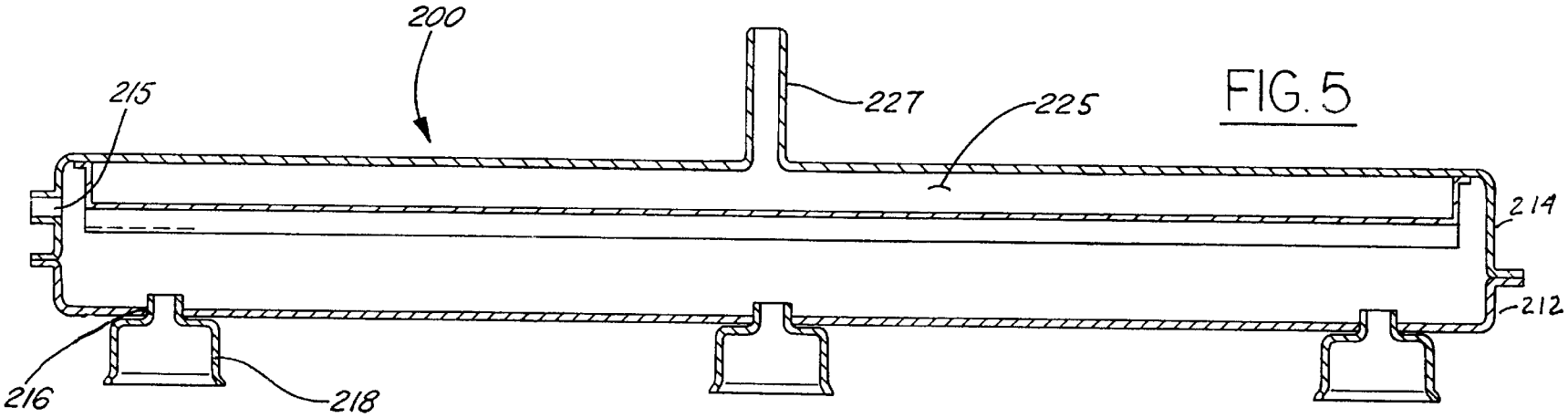
FIG. 5 is a front sectional view of another alternate preferred embodiment fuel rail according to the present invention.
Figure 6:
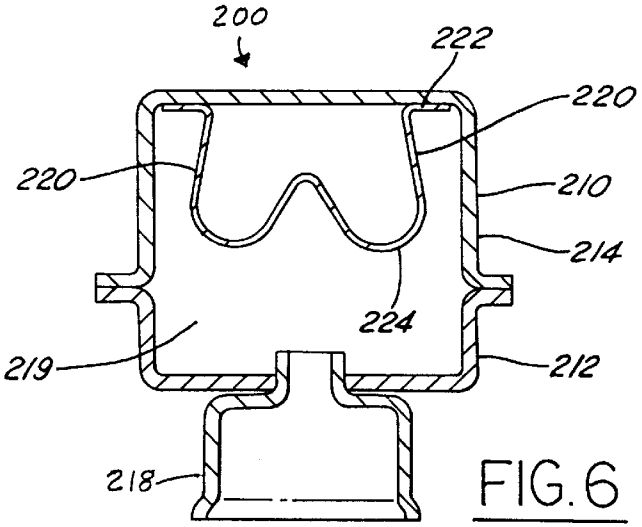
FIG. 6 is a side sectional view of the fuel rail shown in FIG. 5.

Referring additionally to FIGS. 5 and 6, a fuel rail 200 is provided. The fuel rail 200 has a tubular body 210 that has a lower stamped shell 212 and an upper stamped shell 214 and a fuel inlet 215. Fuel rail 200 has a series of injector outlets 216 and fixably connected injector cups 218. Fitted within the control volume 219 of the tubular body 210 is a damper membrane 220.

Damper membrane 220 has a flange portion 222 that is sealably connected to the upper stamped shell 214 by brazing or other suitable process. The upper stamped shell 214 has an inlet 227 which can be optionally left open to allow for connection to a pressurized gas source or can be plugged after the control volume 225 of the damper membrane 220 has been charged in a manner to that previously described.

Figure 7:
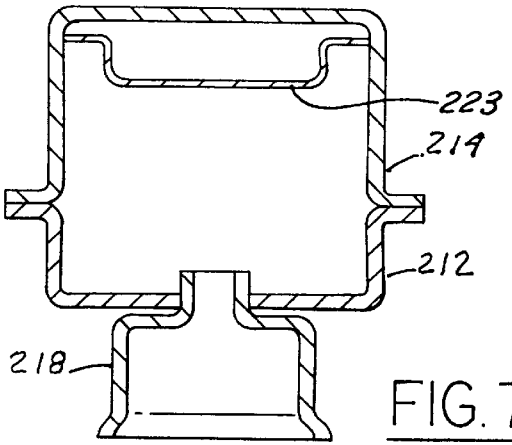
FIG. 7 is a view similar to FIG. 6 of an alternate preferred design of the diaphragm.

The damper membrane 220 has a two lobe design 224 to allow it to elastically expand and contract to dampen pressure pulsations within the tubular body 210. Other single lobe, multiple lobe, and curvilinear cross-sectional shapes such as that shown in FIG. 7 with a diaphragm 223 can be utilized.

Although various embodiments of the present invention have been described, it is obvious to those skilled in the art of the various changes and modifications that can be made to the present invention without departing from the spirit and scope of the invention as it is defined in the accompanying claims.

What is claimed is:

1. A fuel rail for a spark-ignited, reciprocating piston internal combustion engine, comprising:

a tubular body having a fuel inlet, a plurality of injector outlets, and a damper outlet;

injector cups connected with said tubular body adjacent said injector outlets;

a damper lower cup fusion bonded fixably and sealably connected to said tubular rail adjacent said damper outlet;

a damper upper cup containing a volume of gas; and a metallic diaphragm sealably separating said damper upper and lower cups.

2. A fuel rail as described in claim 1, wherein said diaphragm is connected to one of said damper upper and lower cups by crimping.

3. A fuel rail as described in claim 2, wherein said diaphragm is a rigid diaphragm.

4. A fuel rail as described in claim 2, wherein said damper upper and lower cups are crimped together.

5. A fuel rail as described in claim 1, wherein said damper has a travel limiter positioned between said diaphragm and said damper upper cup.

6. A fuel rail as described in claim 5, wherein an end of said travel limiter is positioned within a portion of a nose of said damper upper cup.

7. A fuel rail as described in claim 1, wherein said damper upper cup has a nose which is sealed closed.

8. A fuel rail as described in claim 1, wherein said volume of gas within said damper upper cup is pressurized to a level greater than atmospheric pressure.

9. A fuel rail for a spark-ignited, reciprocating piston internal combustion engine, comprising:

a tubular body having a plurality of injector outlets and a damper outlet;

injector cups connected with said tubular body adjacent said injector outlets;

a damper lower cup fixably connected to said tubular body adjacent said damper outlet;

a damper upper cup having a volume of pressurized gas with a nose deformably sealed shut, said nose having a portion forming a pocket; and a generally rigid diaphragm crimped between said damper upper and lower cups, said rigid diaphragm having a travel limiter connecting thereof and said travel limiter being received within said pocket of said upper cup and said diaphragm sealably separating said damper upper and lower cups.

10. A fuel rail for a spark-ignited, reciprocating piston internal combustion engine comprising:

an elongated tubular body having opposite ends with side walls extending there between having a fuel inlet, a plurality of injector outlets and a damper outlet;

said tubular body having a damper cup stamped integrally in one of said side walls; and a diaphragm sealably connected with said damper cup for separating a control volume of said damper cup from a remainder of said fuel rail.

11. A fuel rail as described in claim 10, wherein said diaphragm is rigid.

12. A fuel rail as described in claim 10, wherein said diaphragm is brazed to said damper cup.

13. A fuel rail as described in claim 10, wherein a gas within said damper cup is pressurized higher than atmospheric.

14. A fuel rail as described in claim 10, wherein said damper cup has a nose which is sealed.

15. A fuel rail as described in claim 10, having a travel limiter contacting said diaphragm.

16. A fuel rail as described in claim 15, wherein said damper cup outlet has a nose with a portion forming a pocket and wherein said travel limiter is connected within said pocket.

17. A fuel rail as described in claim 10, wherein said tubular body has a stamped injector cup adjacent said injector outlets.

18. A fuel rail for a spark-ignited, reciprocating piston internal combustion engine comprising:

a tubular body having a fuel inlet, a plurality of injector outlets and a damper outlet, said tubular body having an integral stamped damper cup adjacent said damper outlet and an integral stamped injector cup adjacent said injector outlets; and a rigid diaphragm brazed to said damper cup sealably separating said damper cup from a remainder of said tubular body and wherein said damper cup has a sealed nose and wherein said damper cup has a control volume pressurized with gas at a pressure higher than atmospheric pressure.

19. A fuel rail for a spark-ignited, reciprocating piston internal combustion engine comprising:

a tubular body having a fuel inlet and a plurality of injector outlets; and an elongated damper membrane with transverse opposite ends sealably connected to a portion of said tubular body, bifurcating a substantial length of said tubular body, providing a control volume for a gas within a portion of said tubular body sealably separated from a remainder of said tubular body exposed to said fuel inlet for dampening pulsations therein.

20. A fuel rail as described in claim 19, additionally having injector cups fixably connected thereto adjacent said injector outlets.

21. A fuel rail as described in claim 19, wherein said membrane has a two lobe design.

22. A fuel rail as described in claim 19, wherein said membrane has a curvilinear cross sectional design transverse to its elongation.

23. A fuel rail as described in claim 19, wherein the portion of said tubular body which is sealed by said damper membrane is fluidly connected to an outlet to allow admittance of a pressurized gas therethrough.

24. A fuel rail for a spark ignited, reciprocating piston internal combustion engine comprising:

a tubular body having a fuel inlet and a plurality of injector outlets; and a damper membrane sealably connected to a portion of said tubular body providing a sealed control volume for gas within a portion of said tubular body for damping pulsations therein, wherein said membrane has a two-lobe design.

25. A fuel rail for a spark-ignited, reciprocating piston internal combustion engine comprising:

a tubular body having a fuel inlet, a plurality of injector outlets and a damper outlet;

said tubular body having a damper cup stamped therein; and wherein said damper cup includes a nose;

a diaphragm sealably connected with said damper cup for separating a control volume of said damper cup from the remainder of said fuel rail; and wherein said damper cup nose forms a pocket, and a travel limiter is connected within said pocket for contacting said diaphragm.

* * * * *